US009995301B2

(12) United States Patent
Sugihara et al.

(10) Patent No.: US 9,995,301 B2
(45) Date of Patent: Jun. 12, 2018

(54) VANE PUMP AND VANE PUMP MANUFACTURING METHOD

(71) Applicant: KYB Corporation, Tokyo (JP)

(72) Inventors: Masamichi Sugihara, Gifu (JP); Tomoyuki Fujita, Gifu (JP); Tomoyuki Nakagawa, Gifu (JP); Tsutomu Komiya, Gifu (JP)

(73) Assignee: KYB Corporation, Tokyo (JP)

( * ) Notice: Subject to any disclaimer, the term of this patent is extended or adjusted under 35 U.S.C. 154(b) by 42 days.

(21) Appl. No.: 15/123,029

(22) PCT Filed: Mar. 4, 2015

(86) PCT No.: PCT/JP2015/056338
§ 371 (c)(1),
(2) Date: Sep. 1, 2016

(87) PCT Pub. No.: WO2015/137209
PCT Pub. Date: Sep. 17, 2015

(65) Prior Publication Data

US 2017/0067462 A1 Mar. 9, 2017

(30) Foreign Application Priority Data

Mar. 13, 2014 (JP) ..... 2014-050725

(51) Int. Cl.
*F03C 2/00* (2006.01)
*F03C 4/00* (2006.01)
(Continued)

(52) U.S. Cl.
CPC ..... *F04C 2/3448* (2013.01); *F01C 21/0809* (2013.01); *F01C 21/0854* (2013.01);
(Continued)

(58) Field of Classification Search
CPC ..... F04C 2/3446; F04C 2/3448; F04C 15/00; F04C 2230/00; F04C 2230/60;
(Continued)

(56) References Cited

U.S. PATENT DOCUMENTS 4,573,890 A * 3/1986 Hadama ..... F01C 21/10 418/133
4,842,500 A * 6/1989 Fujie ..... F01C 21/10 418/133
(Continued)

FOREIGN PATENT DOCUMENTS

JP 03031592 A * 2/1991 ..... F01C 21/0863
JP H10-266978 A 10/1998
JP 2007247473 A * 9/2007 ..... F01C 21/0863

*Primary Examiner* — Theresa Trieu
(74) *Attorney, Agent, or Firm* — Rabin & Berdo, P.C.

(57) ABSTRACT

A vane pump includes a rotor; a plurality of vanes; a cam ring; and a pump body having an accommodating concave portion accommodating the cam ring. The cam ring includes a ring fitting portions formed in a plurality of regions on an outer circumference and a ring small-diameter portions formed on the outer circumference so as to have an outer diameter smaller than those of the ring fitting portions. The accommodating concave portion has a body fitting portion to which the ring fitting portions is fitted and a body large-diameter portions formed on the inner circumference in a plurality of regions so as to have an inner diameter lager than that of the body fitting portions.

6 Claims, 10 Drawing Sheets

(51) Int. Cl.

| | |
|---|---|
| ***F04C 2/00*** | (2006.01) |
| ***F04C 2/344*** | (2006.01) |
| ***F01C 21/08*** | (2006.01) |
| ***F01C 21/10*** | (2006.01) |
| ***F04C 15/00*** | (2006.01) |

(52) U.S. Cl.
CPC ..... *F01C 21/0863* (2013.01); *F01C 21/10* (2013.01); *F01C 21/108* (2013.01); *F04C 2/3446* (2013.01); *F04C 15/00* (2013.01); *F04C 2230/603* (2013.01); *F04C 2240/10* (2013.01); *F04C 2240/20* (2013.01)

(58) Field of Classification Search
CPC ..... F04C 2230/603; F04C 2240/10; F04C 2240/20; F04C 2240/30; F01C 21/0809; F01C 21/0836; F01C 21/0854; F01C 21/0863; F01C 21/10; F01C 21/108
USPC ..... 418/1, 133, 259–260, 266–268
See application file for complete search history.

(56) References Cited

U.S. PATENT DOCUMENTS 6,149,416 A * 11/2000 Lauth ..... F01C 21/10 418/133
6,666,670 B1 * 12/2003 Hartman ..... F01C 21/0809 418/259

* cited by examiner

VANE PUMP AND VANE PUMP MANUFACTURING METHOD

TECHNICAL FIELD

The present invention relates to a vane pump used as a fluid pressure source and a manufacturing method thereof.

BACKGROUND ART

JP1998-266978 discloses a vane pump including a rotor linked to a driving shaft, a plurality of vanes that are provided so as to be capable of reciprocating in the radial direction relative to the rotor, a cam ring that has an inner circumferential surface on which tip ends of the vanes slide by rotation of the rotor, and a pump body that has an accommodating concave portion for accommodating the cam ring.

With such a vane pump, as the rotor is rotated, the plurality of vanes are reciprocated to expand/contract pump chambers, working oil is sucked from a suction port into the pump chambers in a suction region where the pump chambers are expanded, and the working fluid is discharged from the pump chambers through a discharge port in a discharge region where the pump chambers are contracted.

SUMMARY OF INVENTION

In some of vane pumps, positioning of a cam ring relative to a pump body in the radial direction is achieved by inserting and fitting the cam ring into and to the pump body in the axial direction. With such a vane pump, positioning of the cam ring can be performed with higher precision as a clearance between the cam ring and the pump body is smaller.

On the other hand, if the clearance between the cam ring and the pump body is made small, when the cam ring is inserted into the pump body, even with a slight inclination of the cam ring, the cam ring gets caught in the pump body. Therefore, assemblability of the vane pump is deteriorated. Thus, it is difficult to improve both the positioning precision of the cam ring and the assemblability of the vane pump.

An object of the present invention is to improve assemblability of a vane pump while improving positioning precision of a cam ring of the vane pump.

According to one aspect of the present invention, a vane pump includes a rotor that is linked to a driving shaft; a plurality of vanes that are provided so as to be able to reciprocate in a radial direction relative to the rotor; a cam ring that has an inner circumferential surface on which tip ends of the vanes slide by rotation of the rotor; and a pump body that has an accommodating concave portion accommodating the cam ring. The cam ring includes a first ring outer circumferential portion formed on an outer circumference and a second ring outer circumferential portion that has an outer diameter smaller than that of the first ring outer circumferential portion and is formed on the outer circumference. The accommodating concave portion of the pump body has a first body inner circumferential portion formed on an inner circumference and a second body inner circumferential portion that has an inner diameter greater than that of the first body inner circumferential portion and is formed on the inner circumference. The accommodating concave portion of the pump body and the cam ring are not fitted to each other in a state in which the first ring outer circumferential portion faces against the second body inner circumferential portion, and the accommodating concave portion and the cam ring are fitted to each other by relatively rotating the cam ring with respect to the pump body from this state such that the first ring outer circumferential portion faces against the first body inner circumferential portion.

According to another aspect of the present invention, a vane pump manufacturing method is provided. The vane pump includes: a rotor that is linked to a driving shaft; a plurality of vanes that are provided so as to be able to reciprocate in a radial direction relative to the rotor; a cam ring that has an inner circumferential surface on which tip ends of the vanes slide; and a pump body that has an accommodating concave portion accommodating the cam ring, the cam ring has a first ring outer circumferential portion formed on an outer circumference and a second ring outer circumferential portion that has an outer diameter smaller than that of the first ring outer circumferential portion and is formed on the outer circumference, and the accommodating concave portion of the pump body has a first body inner circumferential portion formed on an inner circumference and a second body inner circumferential portion that has an inner diameter greater than that of the first body inner circumferential portion and is formed on the inner circumference. The vane pump manufacturing method includes an inserting step of accommodating the cam ring into the accommodating concave portion of the pump body such that the first ring outer circumferential portion coincides with the second body inner circumferential portion, and a fitting step of making the first ring outer circumferential portion enter the first body inner circumferential portion to achieve fitting by relatively rotating the cam ring with respect to the pump body.

DESCRIPTION OF EMBODIMENTS

Each embodiment of the present invention will be described below with reference to the drawings.

First Embodiment

An overall configuration of a vane pump 100 according to a first embodiment of the present invention will be described first with main reference to FIGS. 1 to 3.

The vane pump 100 is used as a hydraulic source for a hydraulic apparatus, such as, for example, a power steering apparatus, a transmission, or the like, mounted on a vehicle.

In the vane pump 100, motive force from an engine (not shown) is transmitted to an end portion of a driving shaft 1, and a rotor 2 linked to the driving shaft 1 is rotated. The rotor 2 is rotated in the counterclockwise direction in FIG. 1.

Figure 1:
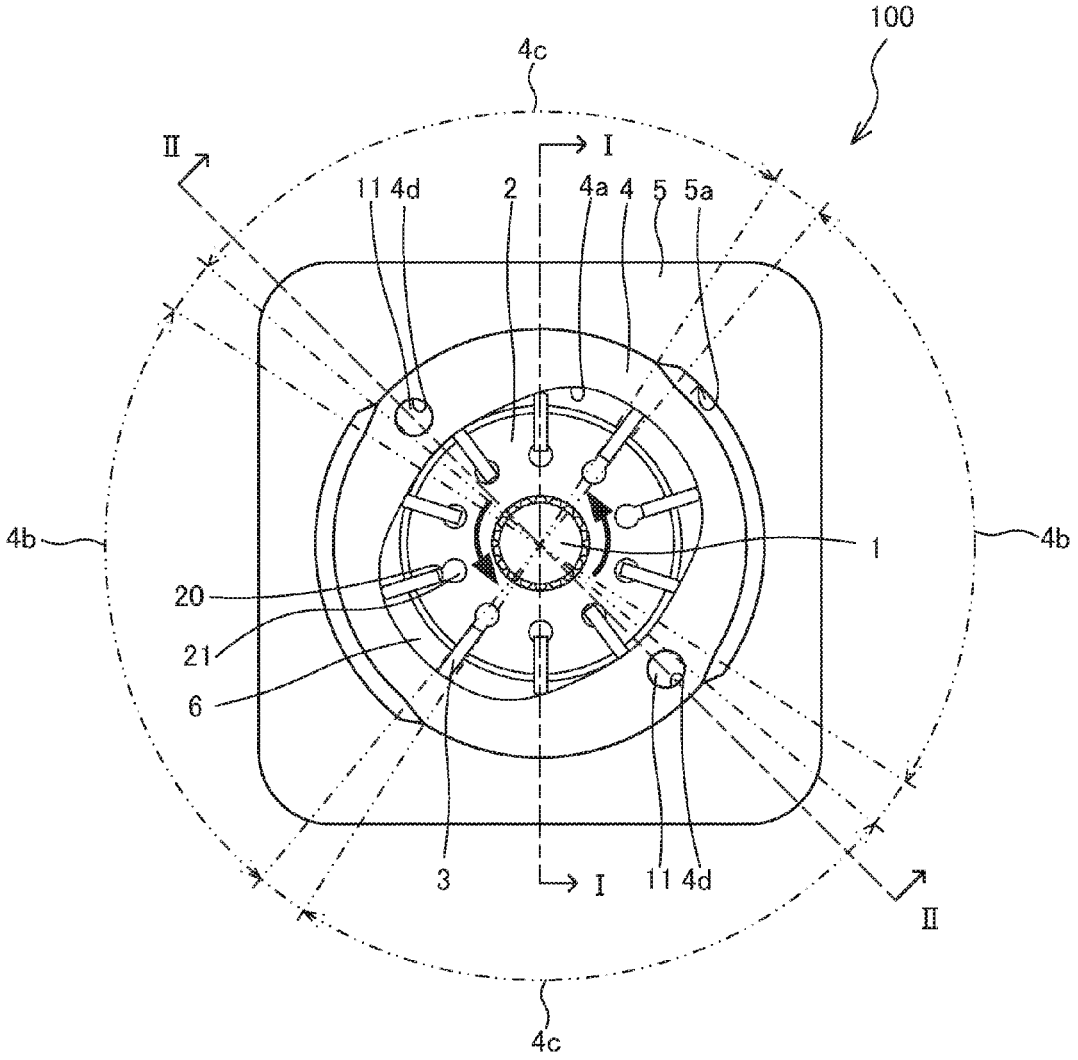
FIG. 1 is a plan view of a vane pump according to a first embodiment of the present invention and is a diagram showing a state in which a pump cover and a second side plate are removed.

As shown in FIG. 1, the vane pump 100 includes a plurality of vanes 3 that are provided so as to be able to reciprocate in the radial direction relative to the rotor 2, a cam ring 4 accommodating the rotor 2 and having a cam face 4*a* serving as an inner circumferential surface on which tip ends of the vanes 3 slide by rotation of the rotor 2, and a pump body 5 having an accommodating concave portion 5*a* accommodating the cam ring 4.

In the rotor 2, slits 20 having openings on an outer circumferential surface of the rotor 2 are formed in a radiating pattern with predetermined gaps therebetween. The vanes 3 are respectively inserted into the slits 20 in a freely reciprocatable manner. At base-end sides of the slits 20, back pressure chambers 21 into which discharge pressure of the pump is guided are defined. The vanes 3 are pushed by the pressure of the back pressure chambers 21 in the directions in which the vanes 3 are drawn out from the slits 20, and tip end portions of the vanes 3 are brought into contact with the cam face 4*a* of the cam ring 4. With such a configuration, a plurality of pump chambers 6 are defined in the cam ring 4 by the outer circumferential surface of the rotor 2, the cam face 4*a* of the cam ring 4, and the adjacent vanes 3.

The cam ring 4 is an annular member in which the cam face 4*a* on the inner circumference thereof has a substantially oval shape. The cam ring 4 has suction regions 4*b* in which volume of each pump chamber 6, which is defined between respective vanes 3 that slide on the cam face 4*a* by the rotation of the rotor 2, is increased and discharge regions 4*c* in which volume of each pump chamber 6 is decreased. As described above, respective pump chambers 6 are expanded/contracted by the rotation of the rotor 2. In this embodiment, the cam ring 4 has two suction regions 4*b* and two discharge regions 4*c*. Regions between the suction regions 4*b* and the discharge regions 4*c* are transition regions in which moving directions of the vanes 3 in the radial direction of the rotor 2 are switched.

The cam ring 4 is accommodated in the accommodating concave portion 5*a* of the pump body 5 and is positioned in the radial direction relative to the pump body 5 by being fitted to the accommodating concave portion 5*a*.

Figure 2:
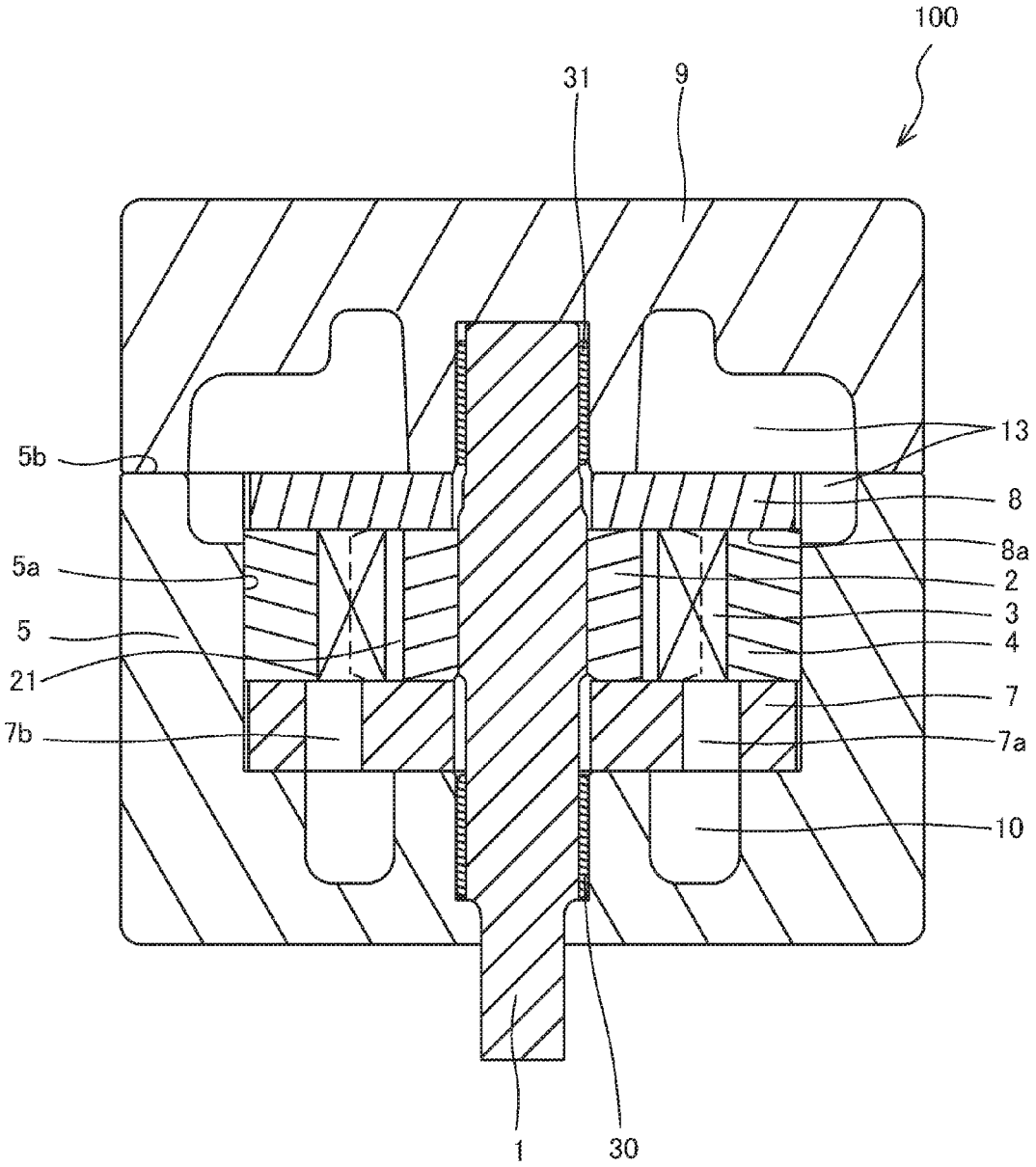
FIG. 2 is a sectional view taken along a line I-I in FIG. 1 and is a diagram showing a state in which the pump cover and the second side plate are attached.

As shown in FIG. 2, the rotor 2, a first side plate 7 that is arranged so as to be in contact with a first side surface (lower side surface in FIG. 2) of the cam ring 4, and a second side plate 8 that is arranged so as to be in contact with a second side surface (upper side surface in FIG. 2) of the cam ring 4 are accommodated in the accommodating concave portion 5*a* of the pump body 5. In other words, the first side plate 7, the cam ring 4, and the second side plate 8 are accommodated in the accommodating concave portion 5*a* in a manner stacked in this order. As described above, the first and second side plates 7 and 8 are arranged in such a manner that both side surfaces of the rotor 2 and the cam ring 4 are sandwiched thereby sealing the pump chambers 6. In addition, in order to prevent the first and second side plates 7 and 8 from getting caught while being accommodated in the accommodating concave portion 5*a* of the pump body 5, sufficient clearance is provided between the first and second side plates 7 and 8 and the accommodating concave portion 5*a*.

A pump cover 9 is provided on the opposite side of the second side plate 8 from the cam ring 4. The pump cover 9 is fastened on the pump body 5 in a state in which an end surface of the pump cover 9 is in contact with an annular end surface 5*b* of the pump body 5. As described above, the accommodating concave portion 5*a* of the pump body 5 is sealed by the pump cover 9.

The driving shaft 1 is rotatably supported by the pump body 5 through a bush 30 and an end portion of the driving shaft 1 is rotatably supported by the pump cover 9 through a bush 31. The driving shaft 1 penetrates through the first and second side plates 7 and 8.

On an end surface 8*a* of the second side plate 8 on which the rotor 2 slides, two arc-shaped suction ports (not shown) are formed so as to respectively open to the two suction regions 4*b* of the cam ring 4 (see FIG. 1) and to guide working oil serving as working fluid to the pump chambers 6.

As shown in FIG. 2, on the first side plate 7, two arc-shaped discharge ports 7*a* and 7*b* are formed by penetrating the first side plate 7 so as to respectively open to the discharge regions 4*c* of the cam ring 4 (see FIG. 1) and to guide the working oil discharged from the pump chambers 6 to a high-pressure chamber 10.

In the pump body 5 and the pump cover 9, a suction passage 13 that communicates a tank (not shown) with the suction ports and guides the working oil in the tank to the pump chambers 6 through the suction ports is formed. In the pump body 5, a discharge passage (not shown) that is in communication with the high-pressure chamber 10 and supplies the working oil in the high-pressure chamber 10 to a hydraulic apparatus at outside is formed.

Figure 3:
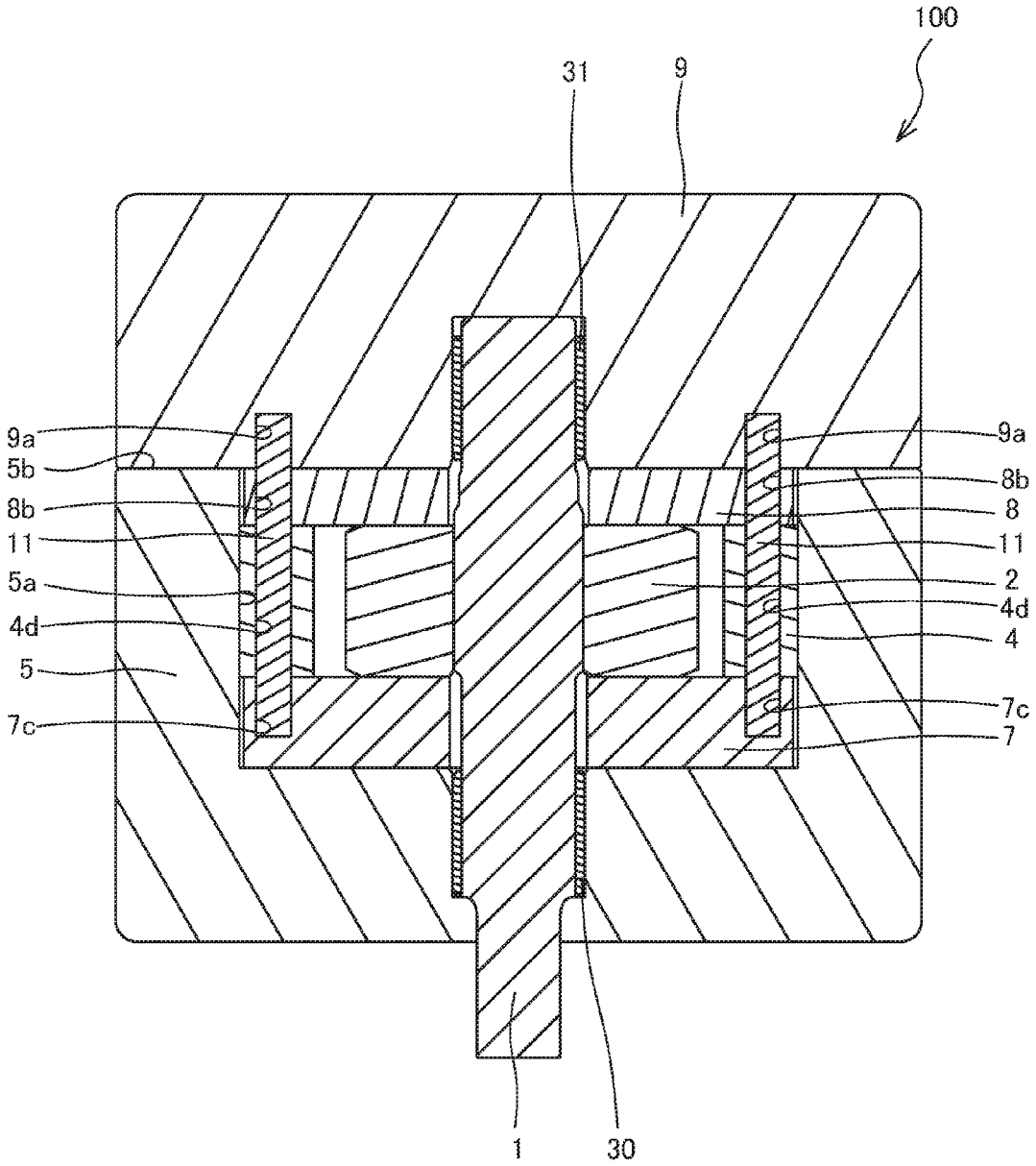
FIG. 3 is a sectional view taken along a line II-II in FIG. 1 and is a diagram showing a state in which the pump cover and the second side plate are attached.

As shown in FIG. 3, positioning pins 11 provided so as to project out from the first side plate 7 are coupled with two pin holes 7*c* formed on the first side plate 7. The positioning pins 11 respectively penetrate through through holes 4*d* formed on the cam ring 4 and through holes 8*b* of the second side plate 8 and are inserted into pin holes 9*a* of the pump cover 9. With the positioning pins 11, relative rotation of the pump cover 9 and the first and second side plates 7 and 8 with respect to the cam ring 4 is restricted. Therefore, positioning of the suction regions 4*b* of the cam ring 4 and the suction ports of the pump cover 9 and positioning of the discharge regions 4*c* of the cam ring 4 and the discharge ports 7*a* and 7*b* of the first side plate 7 are performed.

In the vane pump 100, as the rotor 2 is rotated, the working oil is sucked from the tank through the suction ports and the suction passage 13 into the respective pump chambers 6 in the suction regions 4*b* of the cam ring 4, and the working oil is discharged from the respective pump chambers 6 in the discharge regions 4*c* of the cam ring 4 through the discharge ports 7*a* and 7*b* and the discharge passage to outside. As described above, the vane pump 100 supplies/discharges the working oil by expansion/contraction of the respective pump chambers 6 by the rotation of the rotor 2.

Next, a configuration for positioning the cam ring 4 relative to the pump body 5 will be described in detail.

Figure 4:
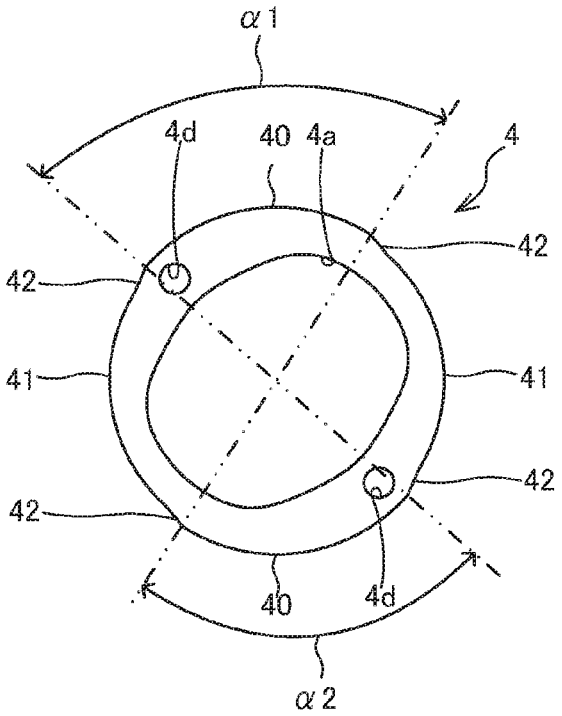
FIG. 4 is a diagram showing a cam ring of the vane pump according to the first embodiment of the present invention.
Figure 5:
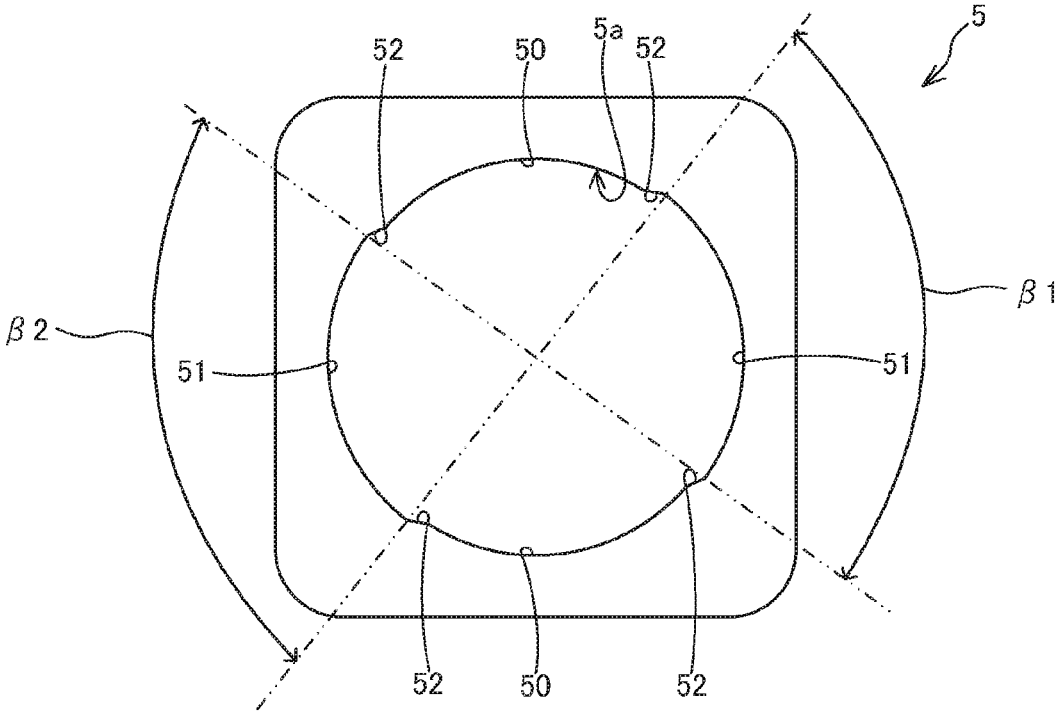
FIG. 5 is a diagram showing a pump body of the vane pump according to the first embodiment of the present invention.
Figure 6:
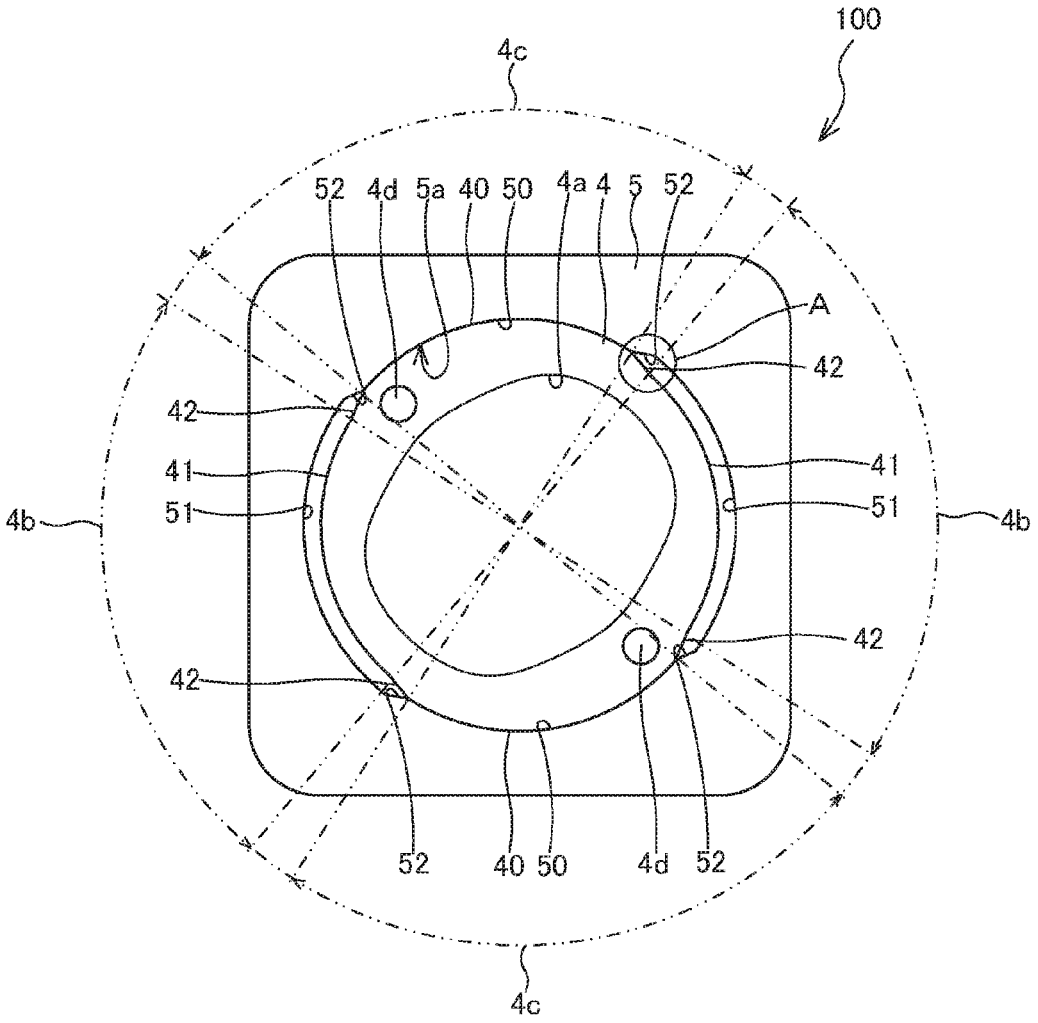
FIG. 6 is a diagram showing a state in which the cam ring and the pump body of the vane pump according to the first embodiment of the present invention are fitted to each other.

FIG. 4 shows a shape of the cam ring 4, and FIG. 5 shows a shape of the pump body 5. FIG. 6 is a diagram showing a state in which the cam ring 4 is fitted to the pump body 5. In FIG. 6, an illustration of configuration other than the cam ring 4 and the pump body 5 is omitted.

As shown in FIG. 4, the cam ring 4 has ring fitting portions 40 serving as first ring outer circumferential portions formed on an outer circumference of the cam ring 4, ring small-diameter portions 41 serving as second ring outer circumferential portions formed on the outer circumference so as to have the diameters smaller than those of the ring fitting portions 40, and ring connecting portions 42 that connect the ring fitting portions 40 and the ring small-diameter portions 41.

The ring fitting portions 40 are formed separately in two regions so as to be symmetrical with respect to the center of the cam ring 4. The ring fitting portions 40 are subjected to a finishing process such as turning.

The ring small-diameter portions 41 are formed, in the two regions between the ring fitting portions 40, so as to be symmetrical with respect to the center of the cam ring 4. The ring small-diameter portions 41 need not be subjected to the finishing process as with the ring fitting portions 40.

Figure 7:
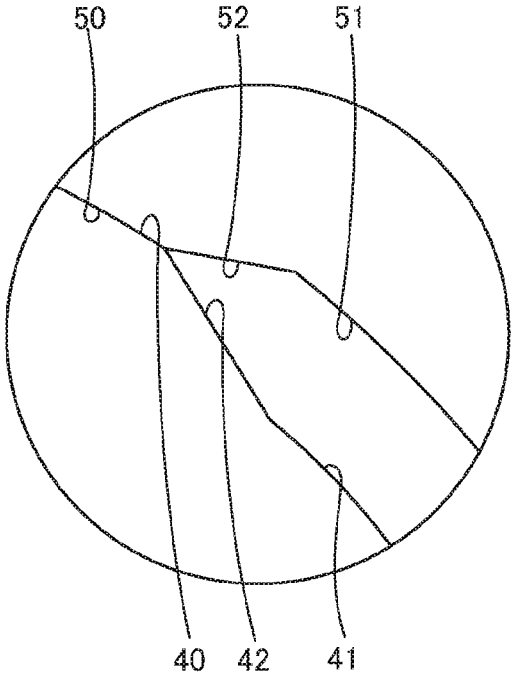
FIG. 7 is an enlarged view of a portion A in FIG. 6.
Figure 8:
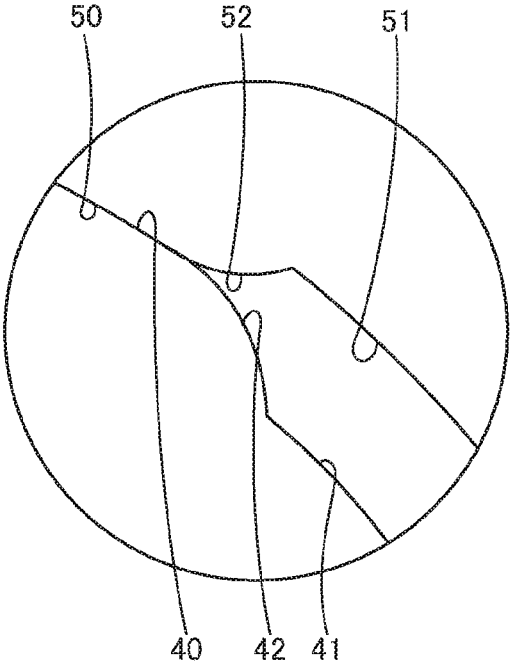
FIG. 8 is a diagram showing a modification of ring connecting portions and body connecting portions of the vane pump according to the first embodiment of the present invention.

The ring connecting portions 42 connect the adjacent ring fitting portions 40 and ring small-diameter portions 41. Therefore, the ring connecting portions 42 are also formed so as to be symmetrical with respect to the center of the cam ring 4. As shown in FIG. 7, the ring connecting portions 42 are formed so as to have tapered shapes whose diameters are gradually reduced from the ring fitting portions 40 formed to have large diameters towards the ring small-diameter portions 41 formed to have small diameters. The shapes of the ring connecting portions 42 are not limited to the tapered shapes, and it suffices to form the ring connecting portions 42 such that the diameters are gradually reduced from the ring fitting portions 40 towards the ring small-diameter portions 41. For example, as shown in FIG. 8, the ring connecting portions 42 may be formed so as to have a curved-surface-shapes.

As shown in FIG. 5, the accommodating concave portion 5*a* of the pump body 5 has body fitting portions 50 serving as first body inner circumferential portions formed on an inner circumference of the pump body 5, body large-diameter portions 51 serving as second body inner circumferential portions formed on the inner circumference so as to have the inner diameters larger than those of the body fitting portions 50, and body connecting portions 52 that connect the body fitting portions 50 and the body large-diameter portions 51.

Similarly to the ring fitting portions 40, the body fitting portions 50 are formed separately in two regions and are formed so as to be symmetrical with respect to the center of the accommodating concave portion 5*a* of the pump body 5. In addition, the body fitting portions 50 are subjected to the finishing process such as turning. Angle ranges in the circumferential direction in which the body fitting portions 50 are formed are formed so as to become the same as angle ranges in the circumferential direction in which the ring fitting portions 40 of the cam ring 4 are formed. Therefore, it is possible to fit the ring fitting portions 40 of the cam ring 4 to the body fitting portions 50 over the entire angle ranges in the circumferential direction (see FIG. 6). The angle ranges of the body fitting portions 50 and the angle ranges of the ring fitting portions 40 may be formed so as to have different angle ranges.

The body large-diameter portions 51 are formed separately in two regions so as to be symmetrical with respect to the center of the accommodating concave portion 5*a*. In addition, the respective regions of the body large-diameter portions 51 are formed so as to have the angle ranges that are equal to or greater than the corresponding angle ranges of the ring fitting portions 40. In other words, angle ranges $\beta 1$ and $\beta 2$ of the body large-diameter portions 51 are formed so as to be greater than angle ranges $\alpha 1$ and $\alpha 2$ of the ring fitting portions 40. Therefore, in a step in which the cam ring 4 is inserted into the pump body 5, which will be described later, by performing the inserting step by allowing the entire region of the ring fitting portions 40 to coincide with the body large-diameter portions 51, it is possible to insert the cam ring 4 into the accommodating concave portion 5*a* of the pump body 5 with a large clearance. The body large-diameter portions 51 need not be subjected to the finishing process as with the body fitting portions 50.

Body connecting portions 52 respectively connect the adjacent body fitting portions 50 and body large-diameter portions 51. Therefore, the body connecting portions 52 are also formed so as to be symmetrical with respect to the center of the accommodating concave portion 5*a*. In addition, the body connecting portions 52 are formed so as to have tapered shapes whose diameters are gradually reduced from the body large-diameter portions 51 formed to have large diameters towards the body fitting portions 50 formed to have small diameters (see FIG. 6). The shapes of the body connecting portions 52 are also not limited to the tapered shapes, and it suffices to form the body connecting portions 52 such that the diameters are gradually reduced from the body large-diameter portions 51 towards the body fitting portions 50.

As shown in FIG. 6, the cam ring 4 is positioned with high precision in the radial direction relative to the pump body 5 by fitting the ring fitting portions 40 to the body fitting portions 50 of the accommodating concave portion 5*a* of the pump body 5, after being mutually subjected to the finishing process. The smaller the clearance between the ring fitting portions 40 and the body fitting portions 50 is, the higher the precision of the positioning can become, and thus, it is possible to prevent a malfunction, such as occurrence of noise, caused by deviation of the cam ring 4 in the radial direction.

In addition, the ring fitting portions 40 and the body fitting portions 50 are formed so as to be fitted to each other in the discharge regions 4*c* in which the volume of each pump chamber 6 is decreased. In the discharge regions 4*c*, in comparison with the suction regions 4*b*, because the pressure of the working oil is high in the pump chambers 6, the cam ring 4 tends to deform due to the pressure of the working oil in the discharge regions 4*c*. However, by fitting the ring fitting portions 40 and the body fitting portions 50 in the discharge regions 4*c*, the pressure of the working oil acting on the cam ring 4 can be received by the pump body 5. Thus, it is possible to suppress the deformation of the cam ring 4 due to the pressure of the working oil.

In addition, the cam ring 4 and the pump body 5 are fitted to each other at the ring fitting portions 40 and the body fitting portions 50. In other words, the ring small-diameter portions 41 is not fitted to the pump body 5, and the body large-diameter portions 51 of the pump body 5 is not fitted to the cam ring 4. Thus, in a forming step of the cam ring 4, the ring small-diameter portions 41 need not be subjected to the finishing process after being formed by a sintering etc. Similarly, in a forming step of the pump body 5, the body large-diameter portions 51 need not be subjected to the finishing process after being formed by a die casting etc. In other words, only the ring fitting portions 40 and the body fitting portions 50 need to be subjected to the finishing process, and the finishing process may not be performed on the entire circumference of the outer circumference of the cam ring 4 and the inner circumference of the pump body 5. Thus, it is possible to reduce material cost and processing cost.

Because the cam ring 4 and the accommodating concave portion 5*a* of the pump body 5 are formed as described above, the cam ring 4 and the accommodating concave portion 5*a* of the pump body 5 are not fitted to each other in a state in which the ring fitting portions 40 are faced against the body large-diameter portions 51. From this state, by relatively rotating the cam ring 4 with respect to the pump body 5 such that the ring fitting portions 40 are faced against the body fitting portions 50, the cam ring 4 is fitted to the accommodating concave portion 5*a* of the pump body 5.

Next, the manufacturing method of the vane pump 100 will be described. An assembly of the vane pump 100 is performed by the following steps.

(1) Temporary Assembly Step

The cam ring 4 is first stacked on the first side plate 7 to which the positioning pins 11 are connected such that the positioning pins 11 penetrate through the through holes 4*d*. The rotor 2 into which the plurality of vanes 3 are inserted is then accommodated in the cam ring 4.

(2) Inserting Step

Figure 9:
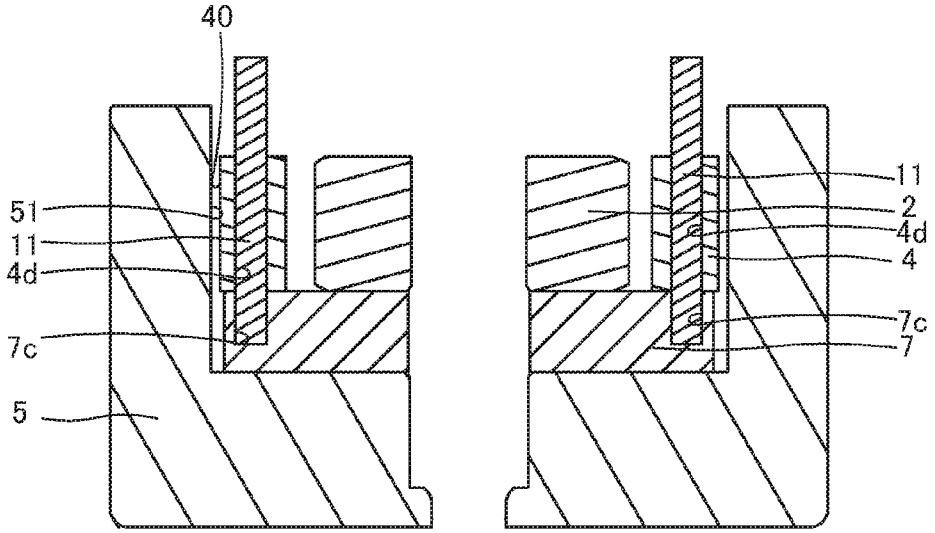
FIG. 9 is a sectional view showing an inserting step of a manufacturing method of the vane pump according to the first embodiment of the present invention.
Figure 10:
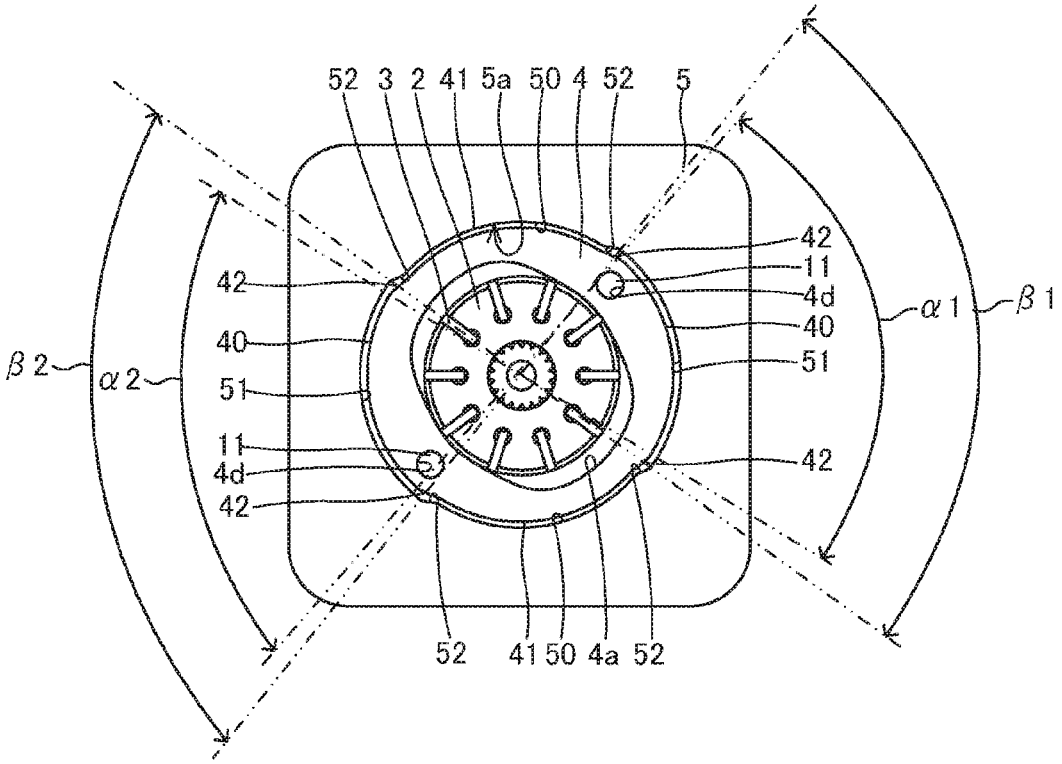
FIG. 10 is a plan view showing the inserting step of the manufacturing method of the vane pump according to the first embodiment of the present invention.

Next, as shown in FIG. 9, the first side plate 7, the positioning pins 11, the cam ring 4, and the rotor 2 that have been assembled in the temporary assembly step (hereinafter, they are referred to as "a temporary assembly" as necessary) are inserted into the pump body 5 in the axial direction and are accommodated in the accommodating concave portion 5*a*. At this time, as shown in FIG. 10, the cam ring 4 is inserted into the accommodating concave portion 5*a* such that the ring fitting portions 40 of the cam ring 4 coincide with the body large-diameter portions 51 in the accommodating concave portion 5*a* of the pump body 5, and the ring small-diameter portions 41 of the cam ring 4 coincide with the body fitting portions 50 of the accommodating concave portion 5*a*.

The ring fitting portions 40 and the body large-diameter portions 51 of the pump body 5 are formed such that the angle ranges $\beta 1$ and $\beta 2$ of the body large-diameter portions 51 are equal to or greater than the corresponding angle ranges $\alpha 1$ and $\alpha 2$ of the ring fitting portions 40. Thus, it is possible to insert the cam ring 4 into the accommodating concave portion 5*a* of the pump body 5 such that the entire range of the ring fitting portions 40 coincides with the body large-diameter portions 51.

Between the ring fitting portions 40 and the body large-diameter portions 51, a clearance that is larger than the clearance formed between the ring fitting portions 40 and the body fitting portions 50 is formed. In addition, between the ring small-diameter portions 41 and the body fitting portions 50, a clearance that is larger than the clearance formed between the ring fitting portions 40 and the body fitting portions 50 is formed. Therefore, by inserting the cam ring 4 into the pump body 5 in such a way, it is possible to insert the cam ring 4 into the pump body 5 with the large clearance. Thus, the cam ring 4 is prevented from getting caught by the pump body 5 due to inclination thereof, and it is possible to accommodate the cam ring 4 into the pump body 5 with ease. In addition, the first side plate 7 of the temporary assembly is formed such that a sufficient clearance is provided for the accommodating concave portion 5*a* of the pump body 5. Thus, the first side plate 7 is also prevented from getting caught in the pump body 5.

(3) Fitting Step

Figure 11:
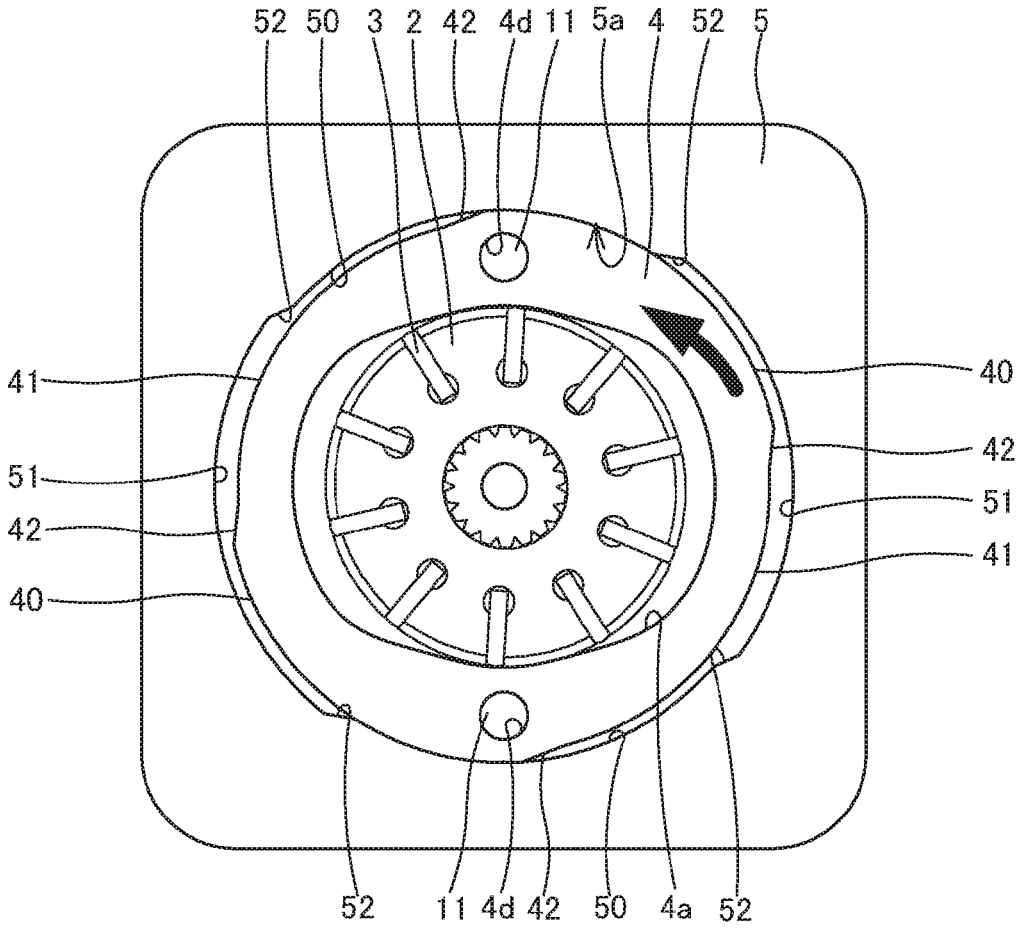
FIG. 11 is a plan view showing a fitting step of the manufacturing method of the vane pump according to the first embodiment of the present invention.

Next, as shown in FIG. 11, by rotating the temporary assembly including the cam ring 4, the ring fitting portions 40 of the cam ring 4 enter the body fitting portions 50 in the accommodating concave portion 5*a* of the pump body, and the ring fitting portions 40 is fitted to the body fitting portions 50.

The temporary assembly is rotated by, for example, holding the positioning pins 11, which penetrate through the through holes 4*d* of the cam ring 4 and connected to the first side plate 7, and by rotating the temporary assembly to a rotation-finish position. The rotation-finish position of the temporary assembly is the position at which the positioning pins 11 can be inserted into the pin holes 9*a* of the pump cover 9 that will be assembled in later steps, in other words, the position at which the positioning pins 11 coincide with the pin holes 9*a* of the pump cover 9. It is possible to calculate the amount of the rotation of the temporary assembly from, for example, an inserting position of the temporary assembly and a designed value of the rotation-finish position. The temporary assembly may be rotated to the rotation-finish position by using angle sensors etc. on the basis of the amount of the rotation thus calculated. The method to achieve the rotation of the temporary assembly is not limited to that described above, and the temporary assembly may be rotated by other methods.

As described above, by rotating the temporary assembly relative to the pump body 5, the ring fitting portions 40 of the cam ring 4 enter the body fitting portions 50 of the accommodating concave portion 5*a* and fitted thereto. Because the temporary assembly is rotated on a bottom portion of the accommodating concave portion 5*a* that is a flat surface, the temporary assembly is prevented from being rotated while being inclined relative to the accommodating concave portion 5*a*.

Here, in the inserting step, a description is given of a fitting step in which the cam ring 4 is accommodated in the accommodating concave portion 5*a* in a state in which the center of the cam ring 4 is deviated from the center of the accommodating concave portion 5*a* of the pump body 5.

If the cam ring 4 is rotated in a state in which the cam ring 4 whose center is deviated is accommodated in the accommodating concave portion 5*a*, the ring connecting portions 42 of the cam ring 4 are brought into contact with the body connecting portions 52 in the accommodating concave portion 5*a* of the pump body 5.

As described above, the ring connecting portions 42 and the body connecting portions 52 are formed to have tapered shapes whose diameters are respectively gradually reduced from the large diameter sides towards the small diameter sides. Thus, even if the ring connecting portions 42 are in contact with the body connecting portions 52, the rotation of the cam ring 4 is not restricted.

Therefore, by further rotating the cam ring 4 from the state in which the ring connecting portions 42 are in contact with the body connecting portions 52, it is possible to allow the ring fitting portions 40 to enter the body fitting portions 50 of the accommodating concave portion 5*a*. As described above, the ring connecting portions 42 and the body connecting portions 52 function as guiding portions that guide the entrance of the ring fitting portions 40 to the body fitting portions 50 along with the relative rotation of the cam ring 4 with respect to the pump body 5.

In other words, by further rotating the cam ring 4 in a state in which the ring connecting portions 42 are in contact with the body connecting portions 52, the cam ring 4 is guided by the ring connecting portions 42 and the body connecting portions 52 and moved in the radial direction such that its center approaches the center of the accommodating concave portion 5*a*. In other words, by rotating the cam ring 4 relative to the pump body 5, an alignment is automatically performed such that the center of the cam ring 4 coincides with the center of the accommodating concave portion 5*a*. By performing the alignment of the cam ring 4, it is possible to allow the ring fitting portions 40 to enter the body fitting portions 50 smoothly.

As described above, even if the center of the cam ring 4 is deviated from the center of the accommodating concave portion 5*a* in the inserting step, the ring connecting portions 42 of the cam ring 4 and the body connecting portions 52 of the accommodating concave portion 5*a* function as the guiding portions. With such a configuration, it is possible to easily fit the ring fitting portions 40 into the body fitting portions 50 just by rotating the cam ring 4.

(4) Final Assembly Step

Next, the driving shaft 1 is penetrated through the first side plate 7 and the pump body 5, and is linked with the rotor 2. Subsequently, the second side plate 8 is stacked on the cam ring 4 and accommodated in the accommodating concave portion 5*a* such that the positioning pins 11 penetrate through the through holes 8*b*. The pump cover 9 is then brought into contact with the pump body 5 such that the positioning pins 11 are inserted into the pin holes 9*a*, and the pump cover 9 and the pump body 5 are fastened by bolts (not shown). With such steps, an assembly of the vane pump 100 is performed.

The embodiment described above affords the following effects.

In the vane pump 100, the cam ring 4 is fitted to the pump body 5 in a state in which the ring fitting portions 40 with large outer diameters on the outer circumference of the cam ring 4 are faced against the body fitting portions 50 with small inner diameters in the accommodating concave portion 5*a* of the pump body 5. In other words, in the state in which the ring fitting portions 40 are faced against the body large-diameter portions 51, the clearance formed between the cam ring 4 and the accommodating concave portion 5*a* is larger than the clearance formed in a state in which the cam ring 4 is fitted to the pump body 5 with the ring fitting portions 40 faced against the body fitting portions 50. Therefore, by inserting the cam ring 4 into the accommodating concave portion 5*a* of the pump body 5 such that the ring fitting portions 40 coincide with the body large-diameter portions 51, it is possible to prevent the cam ring 4 from getting caught in the pump body 5 due to inclination thereof during the inserting cam ring 4 into the accommodating concave portion 5*a*. As described above, in the vane pump 100, the cam ring 4 is fitted to the pump body 5 by inserting the cam ring 4 into the pump body 5 with the relatively large clearance and by relatively rotating the cam ring 4 with respect to the pump body 5. Thus, with the vane pump 100, it is possible to improve assemblability of the vane pump 100 while improving positioning precision of the cam ring 4.

In addition, in the vane pump 100, the ring connecting portions 42 of the cam ring 4 and the body connecting portions 52 of the accommodating concave portion 5*a* function as the guiding portions. Thus, even if the center of the cam ring 4 is deviated from the center of the accommodating concave portion 5*a* when the vane pump 100 is assembled, it is possible to easily fit the ring fitting portions 40 into the body fitting portions 50 just by rotating the cam ring 4. Therefore, because the ring connecting portions 42 of the cam ring 4 and the body connecting portions 52 of the accommodating concave portion 5*a* function as the guiding portions, it is possible to further improve the assemblability of the vane pump 100.

In addition, in the vane pump 100, the ring fitting portions 40 and the body fitting portions 50 are fitted to each other in the discharge regions 4*c* in which the volume of each the pump chamber 6 is decreased. In the discharge regions 4*c*, in comparison with the suction regions 4*b*, because the pressure of the working oil is high in the pump chambers 6, the cam ring tends to deform due to the pressure of the working oil in the discharge regions 4*c*. However, according to the vane pump 100, by fitting the ring fitting portions 40 and the body fitting portions 50 in the discharge regions 4*c*, the pressure of the working oil acting on the cam ring 4 can be received by the pump body 5. Thus, it is possible to suppress the deformation of the cam ring 4.

In addition, in the vane pump 100, the ring small-diameter portions 41 do not fit to the pump body 5, and the body large-diameter portions 51 of the pump body 5 do not fit to the cam ring 4. Thus, the ring small-diameter portions 41 and the body large-diameter portions 51 need not be subjected to the finishing process. In other words, only the ring fitting portions 40 of the cam ring 4 and the body fitting portions 50 of the pump body 5 need to be subjected to the finishing process. Therefore, as compared with a vane pump in which the finishing process is performed on the entire circumference of the outer circumference of the cam ring 4 and the inner circumference of the pump body 5, it is possible to reduce material cost and processing cost.

In the above-mentioned embodiment, the ring fitting portions 40 and the ring small-diameter portions 41 are respectively formed separately in two regions. The body fitting portions 50 and the body large-diameter portions 51 are also respectively formed separately in two regions. In addition, the ring fitting portions 40, the ring small-diameter portions 41, and the ring connecting portions 42 are formed so as to be symmetrical with respect to the center of the cam ring 4. Instead of this configuration, the ring fitting portions 40 and the ring small-diameter portions 41 may be formed separately in more than two regions. Similarly, the body fitting portions 50 and the body large-diameter portions 51 may also be formed separately in more than two regions. In addition, the ring fitting portions 40, the ring small-diameter portions 41, and the ring connecting portions 42 may not be formed so as to be symmetrical with respect to the center of the cam ring 4.

In other words, it is possible to insert the cam ring 4 into the accommodating concave portion 5*a* such that the ring fitting portions 40 coincide with the body large-diameter portions 51, and as long as the cam ring 4 can be rotated and the ring fitting portions 40 can be fitted to the body fitting portions 50, the cam ring 4 and the accommodating concave portion 5*a* of the pump body 5 may be formed so as to have any shape. For example, the cam ring 4 and the accommodating concave portion 5*a* of the pump body 5 may be formed such that two or more ring fitting portions 40 are fitted to one body fitting portion 50 or such that one ring fitting portion 40 is fitted to two or more body fitting portions 50.

In addition, in the above-mentioned embodiment, the ring fitting portions 40 and the body fitting portions 50 are fitted to each other in the discharge regions 4*c*. In order to suppress deformation of the cam ring 4 due to the high-pressure working oil, although it is preferable that a region in which the ring fitting portions 40 and the body fitting portions 50 are fitted to each other be in the discharge regions 4*c*, a part of the fitting region in which the ring fitting portions 40 and the body fitting portions 50 are fitted to each other may be in the discharge regions 4*c*, or all of the fitting region may be outside the discharge regions 4*c* (inside the suction regions 4*b*).

In addition, in the above-mentioned embodiment, both of the ring connecting portions 42 of the cam ring 4 and the body connecting portions 52 in the accommodating concave portion 5*a* of the pump body 5 function as the guiding portions that guide the rotation of the cam ring 4. Instead of this configuration, only the ring connecting portions 42 or the body connecting portions 52 may function as the guiding portion. A part of the ring connecting portions 42 or a part of the body connecting portions 52 may function as the guiding portion. In addition, although it is preferable to have the guiding portion in order to fit the ring fitting portions 40 to the body fitting portions 50 by rotating the cam ring 4 when the cam ring 4 whose center is deviated is inserted into the accommodating concave portion 5*a*, the ring connecting portions 42 and/or the body connecting portions 52 may not function as the guiding portion.

In addition, in the above-mentioned embodiment, the first side plate 7, the positioning pins 11, the cam ring 4, and the rotor 2 are assembled as the temporary assembly in the temporary assembly step, and thereafter, the temporary assembly is inserted into the accommodating concave portion 5*a* of the pump body 5. Instead of this, for example, the first side plate 7 to which the positioning pins 11 are connected may be inserted into the accommodating concave portion 5*a*, and thereafter, the cam ring 4 and the rotor 2 may be inserted into the accommodating concave portion 5*a*, and the cam ring 4 may be rotated. In other words, as long as the manufacturing method of the vane pump 100 includes the step of inserting the cam ring 4 into the accommodating concave portion 5*a* such that the ring fitting portions 40 coincide with the body large-diameter portions 51 and the step of making the ring fitting portions 40 enter the body fitting portions 50 to achieve fitting by relatively rotating the cam ring 4 with respect to the pump body 5, other steps may be set arbitrarily.

Next, vane pumps 200 and 300 according to a second embodiment and a third embodiment of the present invention will be described with reference to FIGS. 12 to 15. In the respective embodiments below, differences from the above-mentioned first embodiment will be mainly described, and components that are the same as those in the vane pump 100 of the above-mentioned first embodiment are assigned the same reference numerals and descriptions thereof shall be omitted. In FIGS. 12 to 15, illustrations of components other than the cam ring and the pump body are omitted.

Second Embodiment

Figure 12:
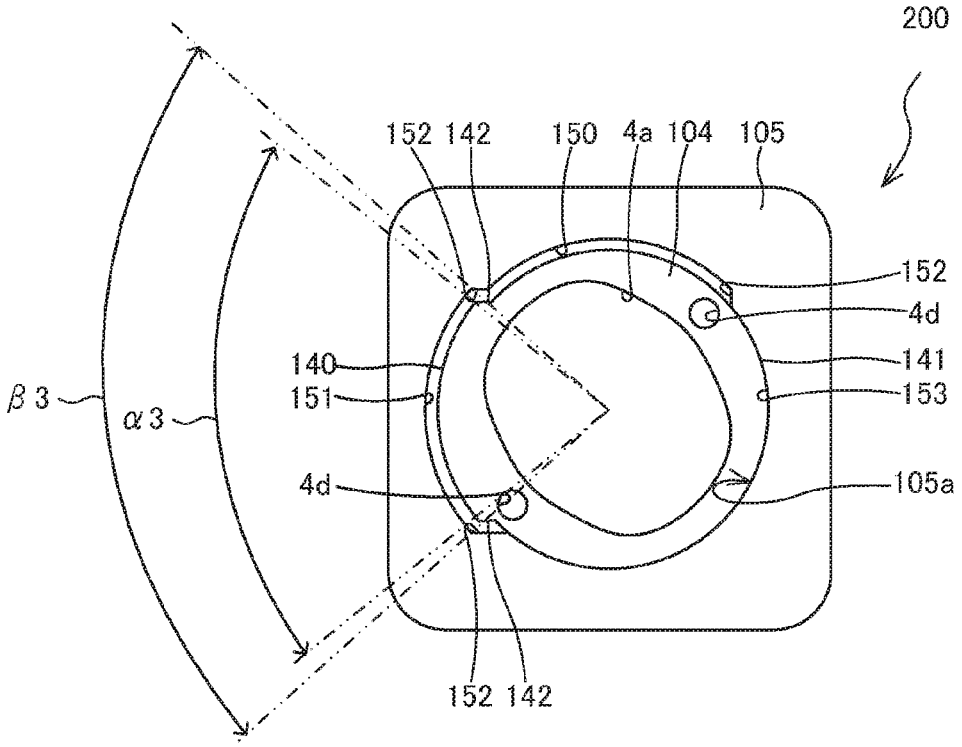
FIG. 12 is a diagram showing a state in which a cam ring and a body of a vane pump according to a second embodiment of the present invention are not fitted to each other.

The vane pump 200 according to the second embodiment of the present invention will be described with reference to FIGS. 12 and 13. FIG. 12 is a diagram showing a state in which a cam ring 104 and a pump body 105 are not fitted to each other, and FIG. 13 is a diagram showing a state in which the cam ring 104 and the pump body 105 are fitted to each other.

In the above-mentioned first embodiment, the first ring outer circumferential portions and the second ring outer circumferential portions of the cam ring 4 are the ring fitting portions 40 and the ring small-diameter portions 41, respectively, that are formed separately in two regions so as to be symmetrical with respect to the center of the cam ring 4. In addition, the first body inner circumferential portions and the second body inner circumferential portions of the accommodating concave portion 5*a* in the pump body 5 are the body fitting portions 50 and the body large-diameter portions 51, respectively, that are formed separately in two regions. The accommodating concave portion 5*a* of the pump body 5 and the cam ring 4 are fitted to each other such that the ring fitting portions 40 coincide with the body fitting portions 50.

Figure 13:
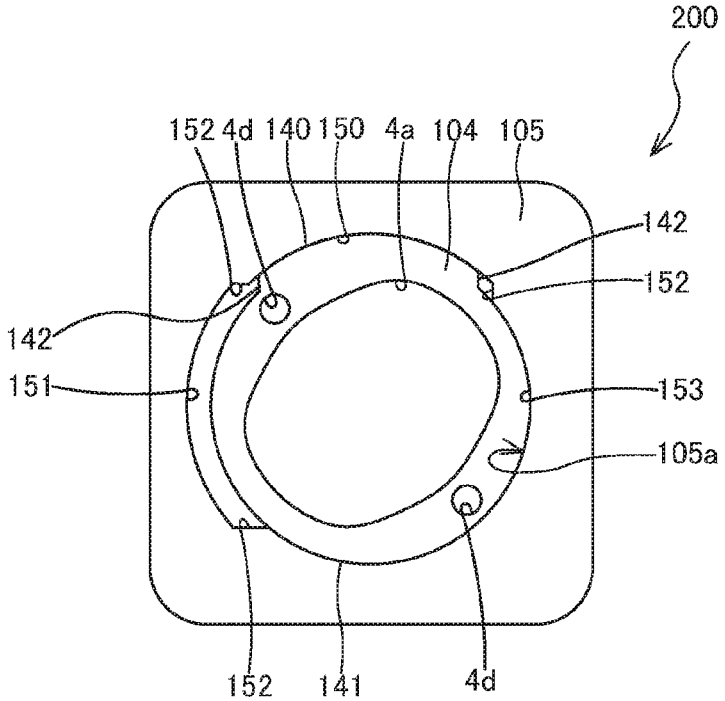
FIG. 13 is a diagram showing a state in which the cam ring and the pump body of the vane pump according to the second embodiment of the present invention are fitted to each other.

In contrast, in the vane pump 200 according to the second embodiment, as shown in FIGS. 12 and 13, the cam ring 104 has a ring fitting portion 140 serving as the first ring outer circumferential portion that is formed on an outer circumference of the cam ring 104 as a single region, and a ring small-diameter portion 141 having the outer diameter smaller than that of the ring fitting portion 140 and serving as the second ring outer circumferential portion that is formed on the outer circumference as a single region. In addition, an accommodating concave portion 105*a* of the pump body 105 has a body fitting portion 150 serving as the first body inner circumferential portion that is formed on an inner circumference of the pump body 105 as a single region, a body large-diameter portion 151 having the inner diameter larger than that of the body fitting portion 150 and serving as the second body inner circumferential portion that is formed on the inner circumference as a single region, and a body small-diameter portion 153 having the inner diameter smaller than that of the body fitting portion 150 and that is formed on the inner circumference as a single region. The accommodating concave portion 105*a* of the pump body 105 and the cam ring 104 are fitted to each other such that the ring fitting portion 140 and the ring small-diameter portion 141 face against the body fitting portion 150 and the body small-diameter portion 153, respectively (see FIG. 13). The vane pump 200 according to the second embodiment differs from the vane pump 100 according to the first embodiment with regard to the above configuration.

As shown in FIGS. 12 and 13, the ring fitting portion 140 and the ring small-diameter portion 141 are each formed in a single region and subjected to the finishing process such as turning.

The cam ring 104 further has ring connecting portions 142 that connect the ring fitting portion 140 with the ring small-diameter portion 141. Similarly to the ring connecting portions 42 of the vane pump 100 according to the above-mentioned first embodiment, the ring connecting portions 142 function as the guiding portions.

The body fitting portion 150 is formed to have the inner diameter that is substantially the same as the outer diameter of the ring fitting portion 140 and subjected to the finishing process such as turning. The body fitting portion 150 functions as the fitting surface at which the cam ring 104 and the accommodating concave portion 105*a* are fitted to each other.

The body large-diameter portion 151 is formed so as to have the angle range that is equal to or greater than the angle range of the ring fitting portion 140. In other words, as shown in FIG. 12, the body large-diameter portion 151 is formed such that an angle range β3 becomes greater than an angle range α3 of the ring fitting portion 140. Similarly to the body large-diameter portions 51 of the vane pump 100 according to the above-mentioned first embodiment, the body large-diameter portion 151 needs not be subjected to the finishing process as with the body fitting portion 150.

The body small-diameter portion 153 is formed to have the angle range equal to or less than 180° and to have the inner diameter that is substantially the same as the outer diameter of the ring small-diameter portion 141. In addition, the body small-diameter portion 153 is subjected to the finishing process such as turning. The body small-diameter portion 153 functions as the fitting surface at which the cam ring 104 and the accommodating concave portion 105*a* are fitted to each other.

The accommodating concave portion 105*a* further has body connecting portions 152 that connect the body fitting portion 150, the body large-diameter portion 151, and the body small-diameter portion 153 that are adjacent to each other. Similarly to the body connecting portions 52 of the vane pump 100 according to the above-mentioned first embodiment, the body connecting portions 152 function as the guiding portions.

The cam ring 104 and the pump body 105 are fitted to each other such that the ring fitting portion 140 and the ring small-diameter portion 141 coincide with the body fitting portion 150 and the body small-diameter portion 153, respectively, after being mutually subjected to the finishing process.

Because the body small-diameter portion 153 is formed to have the angle range equal to or less than 180°, when, as shown in FIG. 12, the cam ring 104 is inserted into the accommodating concave portion 105*a* of the pump body 105 such that the ring fitting portion 140 coincides with the body large-diameter portion 151, the accommodating concave portion 105*a* of the pump body 105 and the cam ring 104 are not fitted to each other. In other words, the cam ring 104 can be inserted into the accommodating concave portion 105*a* through the clearance corresponding to the difference between the outer diameter of the ring fitting portion 140 and the inner diameter of the body large-diameter portion 151.

By forming the cam ring 104 and the accommodating concave portion 105*a* of the pump body 105 as described above, in a state in which the ring fitting portion 140 faces against the body large-diameter portion 151, the accommodating concave portion 105*a* of the pump body 105 and the cam ring 104 are not fitted to each other and a clearance is formed therebetween. In addition, from this state, by relatively rotating the cam ring 104 with respect to the pump body 105 such that the ring fitting portion 140 is faced against the body fitting portion 150 and that the ring small-diameter portion 141 is faced against the body small-diameter portion 153, the accommodating concave portion 105*a* of the pump body 105 and the cam ring 104 are fitted to each other.

The vane pump 200 according to the above-mentioned second embodiment affords the similar effects as those of the first embodiment.

Third Embodiment

Figure 14:
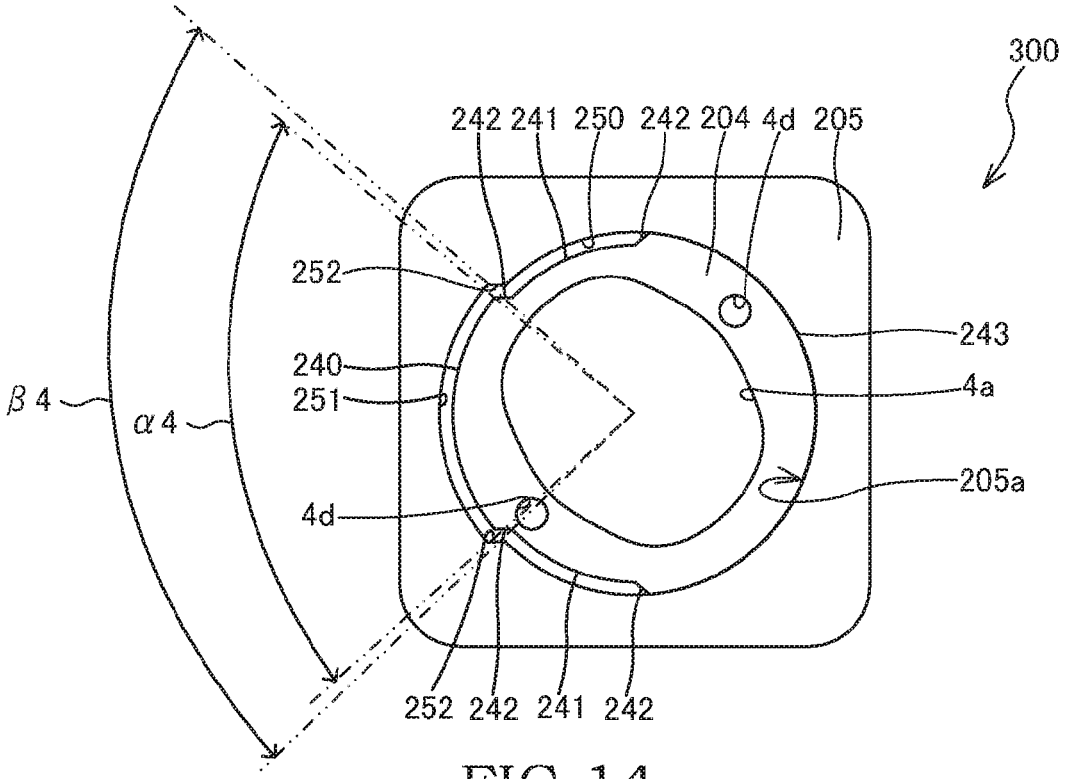
FIG. 14 is a diagram showing a state in which a cam ring and a pump body of a vane pump according to a third embodiment of the present invention are not fitted to each other.

Next, the vane pump 300 according to the third embodiment of the present invention will be described with reference to FIGS. 14 and 15. FIG. 14 is a diagram showing a state in which a cam ring 204 and a pump body 205 are not fitted to each other, and FIG. 15 is a diagram showing a state in which the cam ring 204 and the pump body 205 are fitted to each other.

Figure 15:
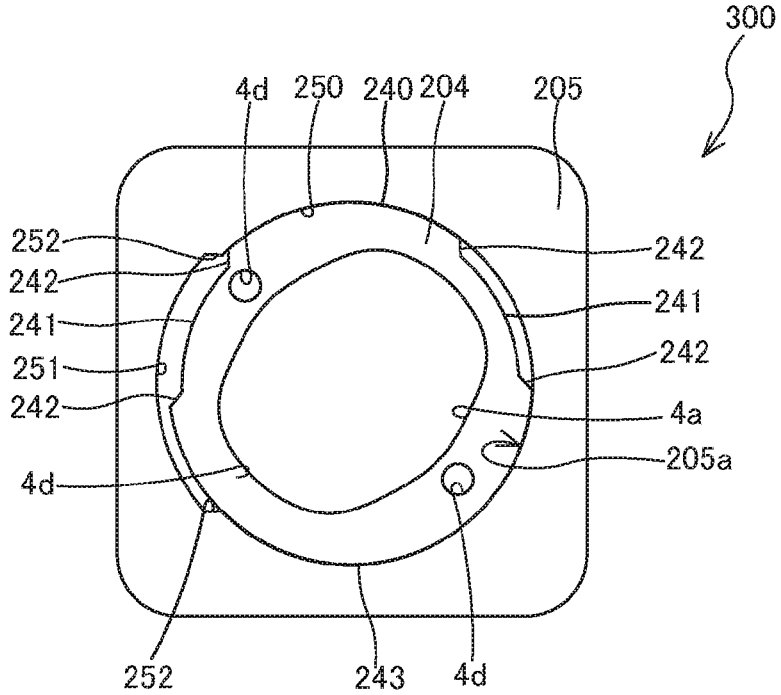
FIG. 15 is a diagram showing a state in which the cam ring and the pump body of the vane pump according to the third embodiment of the present invention are fitted to each other.

In the vane pump 300 according to the third embodiment, as shown in FIGS. 14 and 15, the cam ring 204 has a first ring fitting portion 240 serving as the first ring outer circumferential portion that is formed on an outer circumference of the cam ring 204 as a single region, a second ring fitting portion 243 that is formed on the outer circumference on the opposite side of the first ring fitting portion 240 with respect to the center of the cam ring 204, and ring small-diameter portions 241 serving as the second ring outer circumferential portions that are formed on the outer circumference between the first ring fitting portion 240 and the second ring fitting portion 243. In addition, an accommodating concave portion 205*a* of the pump body 205 has a body fitting portion 250 serving as the first body inner circumferential portion that is formed on an inner circumference of the accommodating concave portion 205*a* as a single region and a body large-diameter portion 251 having the inner diameter greater than the body fitting portion 250 and serving as the second body inner circumferential portion that is formed on the inner circumference as a single region. The accommodating concave portion 205*a* of the pump body 205 and the cam ring 204 are fitted to each other such that the first ring fitting portion 240 and the second ring fitting portion 243 face against the body fitting portion 250 (see FIG. 15). The vane pump 300 according to the third embodiment differs from the vane pump 100 according to the first embodiment with regard to the above configuration.

The first ring fitting portion 240 and the second ring fitting portion 243 have the same outer diameter, are formed so as to face against each other with the center of the cam ring 204 located therebetween, and are respectively subjected to the finishing process such as turning. The first ring fitting portion 240 and the second ring fitting portion 243 are respectively formed so as to have the angle ranges equal to or less than 180°.

The ring small-diameter portions 241 have the outer diameters smaller than those of the first ring fitting portion 240 and the second ring fitting portion 243 and are formed between the first ring fitting portion 240 and the second ring fitting portion 243. The ring small-diameter portions 241 need not be subjected to the finishing process.

The cam ring 204 has ring connecting portions 242 that connect the first ring fitting portion 240, the ring small-diameter portions 241, and the second ring fitting portion 243 that are adjacent to each other. Similarly to the ring connecting portions 42 of the vane pump 100 according to the above-mentioned first embodiment, the ring connecting portions 242 function as the guiding portions.

The body fitting portion 250 is formed to have the inner diameter that is substantially the same as the outer diameters of the first ring fitting portion 240 and the second ring fitting portion 243 and is subjected to the finishing process such as turning. Thus, the body fitting portion 250 functions as the fitting surface at which the cam ring 204 and the pump body 205 are fitted to each other.

The body large-diameter portion 251 is formed so as to have the angle range that is equal to or greater than the angle range of the first ring fitting portion 240. In other words, as shown in FIG. 14, the body large-diameter portion 251 is formed such that an angle range β4 becomes greater than an angle range α4 of the first ring fitting portion 240. Similarly to the body large-diameter portions 51 of the vane pump 100, the body large-diameter portion 251 needs not be subjected to the finishing process.

In addition, the accommodating concave portion 205*a* further has body connecting portions 252 that connect the body fitting portion 250 and the body large-diameter portion 251. Similarly to the body connecting portions 52 of the vane pump 100 according to the above-mentioned first embodiment, the body connecting portions 252 function as the guiding portions.

The cam ring 204 and the pump body 205 are fitted to each other such that the first ring fitting portion 240 and the second ring fitting portion 243 respectively coincide with the body fitting portion 250, after being mutually subjected to the finishing process.

Because the first ring fitting portion 240 and the second ring fitting portion 243 are respectively formed to have the angle ranges equal to or less than 180°, when, as shown in FIG. 14, the cam ring 204 is inserted into the accommodating concave portion 205*a* of the pump body 205 such that the first ring fitting portion 240 coincides with the body large-diameter portion 251, the accommodating concave portion 205*a* of the pump body 205 and the cam ring 204 are not fitted to each other. In other words, the cam ring 204 can be inserted into the accommodating concave portion 205*a* through the clearance corresponding to the difference between the outer diameter of the first ring fitting portion 240 and the inner diameter of the body large-diameter portion 251.

By forming the cam ring 204 and the accommodating concave portion 205*a* of the pump body 205 as described above, in a state in which the first ring fitting portion 240 faces against the body large-diameter portion 251, the cam ring 204 and the accommodating concave portion 205*a* of the pump body 205 are not fitted to each other and a clearance is formed therebetween. In addition, from this state, by relatively rotating the cam ring 204 with respect to the pump body 205 such that the first ring fitting portion 240 and the second ring fitting portion 243 are faced against the body fitting portion 250, the cam ring 204 and the accommodating concave portion 205*a* of the pump body 205 are fitted to each other.

The vane pump 300 according to the above-mentioned third embodiment affords the similar effects as those of the first embodiment.

Embodiments of this invention were described above, but the above embodiments are merely examples of applications of this invention, and the technical scope of this invention is not limited to the specific constitutions of the above embodiments.

This application claims priority based on Japanese Patent Application No. 2014-50725 filed with the Japan Patent Office on Mar. 13, 2014, the entire contents of which are incorporated into this specification.

The invention claimed is:

1. A vane pump comprising:

a rotor that is linked to a driving shaft;

a plurality of vanes that are provided so as to reciprocate in a radial direction relative to the rotor;

a cam ring that has an inner circumferential surface on which tip ends of the vanes slide by rotation of the rotor; and a pump body that has an accommodating concave portion accommodating the cam ring, wherein:

the cam ring includes a first ring outer circumferential portion formed on an outer circumference, and a second ring outer circumferential portion that has an outer diameter smaller than that of the first ring outer circumferential portion and is formed on the outer circumference;

the accommodating concave portion of the pump body has a first body inner circumferential portion formed on an inner circumference, and a second body inner circumferential portion that has an inner diameter greater than that of the first body inner circumferential portion and is formed on the inner circumference; and the accommodating concave portion of the pump body and the cam ring are not fitted to each other in a state in which the first ring outer circumferential portion faces against the second body inner circumferential portion, and the accommodating concave portion and the cam ring are fitted to each other by relatively rotating the cam ring with respect to the pump body from this state such that the first ring outer circumferential portion faces against the first body inner circumferential portion.

2. The vane pump according to claim 1, wherein, each region of the first ring outer circumferential portion and respectively corresponding each region of the second body inner circumferential portion are formed such that an angle range of the first ring outer circumferential portion is equal to or less than an angle range of the second body inner circumferential portion.

3. The vane pump according to claim 1, wherein, the cam ring has a ring connecting portion connecting the first ring outer circumferential portion and the second ring outer circumferential portion, the accommodating concave portion has a body connecting portion connecting the first body inner circumferential portion and the second body inner circumferential portion, and at least one of the ring connecting portion and the body connecting portion functions as a guiding portion that guides entrance of the first ring outer circumferential portion to the first body inner circumferential portion by relative rotation of the cam ring with respect to the pump body.

4. The vane pump according to claim 3, wherein, at least one of the ring connecting portion and the body connecting portion functioning as the guiding portion is formed such that a diameter is gradually reduced from the first ring outer circumferential portion or the second body inner circumferential portion formed to have a large diameter towards the second ring outer circumferential portion or the first body inner circumferential portion formed to have a small diameter.

5. The vane pump according to claim 1, wherein, pump chambers are defined by the adjacent vanes and the inner circumferential surface of the cam ring, and the first ring outer circumferential portion faces against the first body inner circumferential portion in a discharge region where the pump chambers are contracted as the rotor is rotated and the cam ring and the pump body are fitted to each other.

6. A vane pump manufacturing method in which the vane pump includes:

a rotor that is linked to a driving shaft;

a plurality of vanes that are provided so as to reciprocate in a radial direction relative to the rotor;

a cam ring that has an inner circumferential surface on which tip ends of the vanes slide; and a pump body that has an accommodating concave portion accommodating the cam ring, the cam ring has a first ring outer circumferential portion formed on an outer circumference, and a second ring outer circumferential portion that has an outer diameter smaller than that of the first ring outer circumferential portion and is formed on the outer circumference, and the accommodating concave portion of the pump body has a first body inner circumferential portion formed on an inner circumference, and a second body inner circumferential portion that has an inner diameter greater than that of the first body inner circumferential portion and is formed on the inner circumference, wherein the manufacturing method comprises an inserting step of accommodating the cam ring into the accommodating concave portion of the pump body such that the first ring outer circumferential portion coincides with the second body inner circumferential portion, and a fitting step of making the first ring outer circumferential portion enter the first body inner circumferential portion to achieve fitting by relatively rotating the cam ring with respect to the pump body.

* * * * *